US005762047A

United States Patent [19]

Yoshioka et al.

[11] Patent Number: 5,762,047

[45] Date of Patent: Jun. 9, 1998

[54] FUEL SUPPLYING APPARATUS

[75] Inventors: Hiroshi Yoshioka; Shigeki Kanamaru, both of Tokyo, Japan

[73] Assignee: Mitsubishi Denki Kabushiki Kaisha, Tokyo, Japan

[21] Appl. No.: 696,664

[22] Filed: Aug. 14, 1996

[30] Foreign Application Priority Data

Feb. 14, 1996 [JP] Japan ..... 8-026863

[51] Int. Cl.[6] ..... F02M 37/04

[52] U.S. Cl. ..... 123/509; 123/514; 417/313

[58] Field of Search ..... 123/509, 514, 123/497, 457, 510; 137/569; 251/120; 417/275, 313, 423.3

[56] References Cited

U.S. PATENT DOCUMENTS

| | | | |
|---|---|---|---|
| 4,844,704 | 7/1989 | Jiro | 417/313 |
| 5,195,494 | 3/1993 | Tuckey | 123/514 |
| 5,289,810 | 3/1994 | Bauer et al. | 123/514 |
| 5,341,842 | 8/1994 | Chih et al. | 123/514 |
| 5,361,742 | 11/1994 | Briggs et al. | 123/514 |
| 5,392,750 | 2/1995 | Laue et al. | 123/509 |
| 5,413,077 | 5/1995 | Hornby et al. | 123/457 |
| 5,433,241 | 7/1995 | Robinson | 137/115 |
| 5,435,344 | 7/1995 | Robinson et al. | 123/514 |
| 5,469,829 | 11/1995 | Kleppner et al. | 123/514 |
| 5,511,957 | 4/1996 | Tuckey et al. | 417/313 |
| 5,520,156 | 5/1996 | Brunnhofer | 123/510 |
| 5,564,396 | 10/1996 | Kleppner et al. | 123/509 |
| 5,613,476 | 3/1997 | Oi et al. | 123/509 |

FOREIGN PATENT DOCUMENTS

| | | |
|---|---|---|
| 0678664A2 | 10/1995 | European Pat. Off. . |
| 4425252A1 | 1/1996 | Germany . |
| 63-255562 | 10/1988 | Japan . |
| 02191862 | 7/1990 | Japan . |
| 2-191862 | 7/1990 | Japan . |
| 03105055 | 5/1991 | Japan . |
| 07180630 | 12/1993 | Japan . |
| 7-180630 | 7/1995 | Japan . |

*Primary Examiner*—Thomas N. Moulis

*Attorney, Agent, or Firm*—Burns, Doane, Swecker & Mathis, LLP

[57] ABSTRACT

A fuel supplying apparatus comprising a fuel tank, a fuel pump, a pressure regulator and a fuel filter disposed in a fuel line connected between the fuel pump and the pressure regulator for filtering the fuel supplied from the fuel pump. The pressure regulator has an inlet port through which the pressure within the fuel tank is introduced into the diaphragm chamber of the pressure regulator is disposed between a fuel surface level and the ceiling of the fuel tank. The excess fuel discharge port is disposed in the vicinity of and in a facing relationship to a wall surface, which may be provided with a shock absorbing member, of a fuel pump mounting bracket, a sub-tank, pressure regulator holder or a barrier. The fuel filter has a hollow cylindrical configuration and the fuel pump together with a mounting bracket for supporting the fuel pump is housed within the hollow cylindrical fuel filter.

17 Claims, 11 Drawing Sheets

FUEL SUPPLYING APPARATUS

BACKGROUND OF THE INVENTION

This invention relates to a fuel supplying apparatus which supplies pressurized fuel to a fuel injector for injecting fuel into an internal combustion engine.

FIG. 10 illustrates a conventional fuel supplying apparatus shown in Japanese Pat. Laid-Open No. 7-180630. In the figure, the reference numeral 11 is a fuel tank, 12 is a fuel pump disposed within the fuel tank 11, 13 is a pressure regulator connected to a discharge port of the fuel pump, 14 is a fuel filter disposed exterior of the fuel tank 11 for filtering any foreign matter or dust entrained within the fuel, 15 is an injector for injecting fuel into each cylinder 16 of an engine and 17 is a return pipe for returning a portion of the fuel from the pressure regulator 13 to the fuel tank 11 as an excess fuel (hereinafter referred to as return fuel).

FIG. 11 illustrates the main portion within the fuel tank of the fuel supplying apparatus shown in FIG. 10. In the figure, the reference numeral 18 is a fuel chamber within the pressure regulator 13, 19 is a diaphragm chamber, 20 is a diaphragm portion for separating the fuel chamber 18 and the diaphragm chamber 19 from each other and is movable in the transverse direction in the FIG. 21 is a valve member fitted over the diaphragm portion 20 for actuating in cooperation with the diaphragm portion 20, 22 is a spring for biasing the valve member 21 into a closed position, 23 is a tank internal pressure introducing pipe for introducing the pressure within the fuel tank 11 from the fuel tank 11 to the diaphragm chamber 19 of the pressure regulator 13, and 24 is a mounting bracket for supporting the fuel pump 12 within the fuel tank 11.

In the conventional fuel supplying apparatus as described above, the fuel stored within the fuel tank 11 is pressurized and pumped by the fuel pump 12 to the pressure regulator 13. The pressure regulator 13 regulates the pressure of the fuel supplied to the injector 15 at a pressure higher than the tank internal pressure lead through the tank internal pressure introducing pipe 23 (shown in FIG. 11) by a predetermined constant valve (3.0 kgf/cm$^2$, for example) by returning through the return pipe 17 a portion of the fuel supplied to the fuel tank 11.

The details of the pressure regulator 13 will now be described in conjunction with FIG. 11. When the pressure of the fuel pumped from the fuel pump 12 and filled in the fuel chamber 18 of the pressure regulator 13 becomes higher than the pressure set at a pressure higher by a predetermined constant value than the tank internal pressure introduced into the diaphragm chamber 19 through the tank internal pressure introducing pipe 23, this pressure difference causes the diaphragm portion 20 to be displaced against the biasing force of the spring 22. This causes the diaphragm portion 20 and the valve member 21 to separate from the valve seat (not shown) disposed on the inlet 17*a* of the return pipe 17 to allow the fuel to be discharged from the return pipe 17 into the fuel tank 11, whereby the pressure of the fuel supplied from the fuel pump 12 to the injector 15 (FIG. 10) can be decreased.

On the other hand, when the pressure of the fuel within the fuel chamber 18 becomes lower than the pressure set at a pressure higher by a predetermined constant value than the tank internal pressure introduced into the diaphragm chamber 19 through the tank internal pressure introducing pipe 23, the diaphragm portion 20 is urged by the spring 22 (not shown) to displace the valve member 21 together with the diaphragm portion 20 toward the valve seat (not shown) disposed at the inlet 17*a* of the return pipe 17. When the valve member 21 approaches close to the valve seat, the cross sectional area of the opening of the inlet 17*a* of the return pipe 17 is decreased to correspondingly reduce the amount of the fuel returned to the fuel tank 11 from the fuel chamber 18 through the return pipe 17. Therefore, the pressure of the fuel supplied to the injector 15 (shown in FIG. 10) from the fuel pump 12 can be increased.

Thus, the fuel pressure within the fuel chamber 18 in the pressure regulator 13 can be regulated at a constant value relative to the pressure within the fuel tank 11, whereby the pressure of the fuel supplied to the injector 15 can be maintained constant.

Then, in the arrangement shown in FIG. 10, the fuel regulated at a pressure higher by a constant value relative to the pressure in the fuel tank 11 is supplied through the fuel filter 14 to the injector 15 from which it is injected into each cylinder of the engine 16.

In the conventional fuel supply apparatus, the fuel pressure, which is set by the pressure regulator 13 at a pressure higher by a constant value relative to the tank internal pressure, is decreased before it is supplied to the injector 15 due to the pressure loss upon flowing through the fuel filter 14 disposed downstream of the pressure regulator 13. Since the degree of the pressure loss is not constant and dependent upon the conditions of the foreign matters trapped in a filter element (not shown) within the fuel filter 14, the fuel pressure supplied to the injector 15 cannot be maintained at a constant value, resulting in a problem that the amount of the fuel injection from the injector 15 is changeable.

Also, since the tank internal pressure introducing pipe 23 of the pressure regulator 13 is opened at about the central portion in the depth direction of the fuel tank 11, when the fuel level F (shown by a dot-and-dash line in FIG. 11) is at a position higher than the opening of the tank internal pressure introducing pipe 23, the fuel flows from the tank internal pressure introducing pipe 23 into the diaphragm chamber 19 and is effected by the pressure due to the fuel head H (shown in FIG. 11) from the fuel level F to the opening of the tank internal pressure introducing pipe 23, making it disadvantageously difficult to set the fuel pressure at a pressure higher by a constant value relative to the tank internal pressure.

Further, when the fuel, which is regulated by the pressure regulator 13 and which is discharged as a return fuel from the pressure regulator 13 to the fuel tank 11, is directly discharged from the pressure regulator 13 onto the fuel surface, a noise generates, so that the return pipe 17 must be elongated to position the discharge port 17*b* in the vicinity of the bottom wall of the fuel tank 11.

SUMMARY OF THE INVENTION

Accordingly, one object of the present invention is to provide a fuel supplying apparatus free from the above discussed problems of the conventional fuel supply apparatus.

Another object of the present invention is to provide a fuel supplying apparatus in which the pressure of the fuel supplied to the injector can be regulated at a set value irrespective of the pressure loss upon the flowing through the fuel filter.

Another object of the present invention is to provide a fuel supplying apparatus in which the fuel pressure can be regulated by the pressure regulator without the effect of the fuel head within the fuel tank.

A further object of the present invention is to provide a fuel supplying apparatus in which the return pipe of the pressure regulator is not needed to be extended close to the bottom wall of the fuel tank in order to alleviate the noise which generates when the return fuel of the pressure regulator directly drops on the fuel surface in the fuel tank.

Still another object of the present invention is to provide a fuel supplying apparatus which can be mounted at a lower height within the fuel tank and improves the degree of freedom for mounting in the thin-type fuel tank.

With the above objects in view, the present invention resides in a fuel supplying apparatus comprising a fuel tank, a fuel pump disposed within the fuel pump for pumping fuel to a fuel injector of an internal combustion engine, a pressure regulator disposed within the fuel tank for regulating the pressure of the fuel pumped from the fuel pump and for returning an excess amount of the fuel from a fuel supply path to the fuel injector to the fuel tank as an excess fuel. The fuel supplying apparatus further comprises a fuel filter disposed in a fuel line connected between the fuel pump and the pressure regulator for filtering the fuel supplied from the fuel pump.

In a fuel supplying apparatus of the present invention, the pressure regulator may have defined therein a diaphragm chamber and a fuel chamber partitioned by a diaphragm portion, the fuel chamber receiving a supply of fuel pumped from the fuel pump and pumping the fuel to the fuel injector. The diaphragm chamber supplies the excess fuel to the fuel tank by the displacement of the diaphragm portion in response to the fuel pressure within the fuel chamber relative to the pressure within the diaphragm chamber for regulating the fuel pressure within the fuel chamber. The pressure regulator may have an inlet port through which the pressure within the fuel tank is introduced into the diaphragm chamber of the pressure regulator and which is disposed between a fuel surface level and the ceiling of the fuel tank.

The pressure regulator may comprise an excess fuel discharge port disposed in the vicinity of and in a facing relationship to a wall surface of a mounting bracket for supporting the fuel pump within the fuel tank.

The fuel tank may be provided therein with a sub-tank for maintaining therein a fuel for being suctioned by the fuel pump when the fuel tank is tilted, and the pressure regulator may comprise an excess fuel discharge port disposed in the vicinity of and in a facing relationship to a wall surface of the sub-tank.

The wall surface to which the fuel discharged from the excess fuel discharge port impinges may comprise a shock absorbing member.

The fuel filter may have a hollow cylindrical configuration and the fuel pump together with a mounting bracket for supporting the fuel pump is housed within the hollow cylindrical fuel filter.

The fuel filter may have a hollow cylindrical configuration, the fuel pump together with a mounting bracket for supporting the fuel pump may be housed within the hollow cylindrical fuel filter, the fuel filter having integrally formed therein a filter in-flow pipe through which the fuel flows into the fuel filter and a filter out-flow pipe through which the filtered fuel flows out from the filter to the pressure regulator, and the filter in-flow pipe may be directly connected to a fuel outlet pipe of the fuel pump and the filter out-flow pipe may be directly connected to a regulator in-flow pipe of the pressure regulator.

The fuel supplying apparatus may further comprise a first bracket secured to a cover of the fuel tank, a second bracket connected to the first bracket selectively at a connection portion of the first bracket, a pump holder portion disposed to the second bracket for holding the fuel pump and a filter holding portion disposed to the second bracket for elastically holding the fuel filter.

The fuel filter may have mounted thereon a holder for holding the pressure regulator, the holder having a wall surface disposed in a facing relationship with the excess fuel outlet port of the pressure regulator.

The fuel supplying apparatus may further comprise a barrier wall mounted to a case of the fuel filter such that the barrier wall is in a facing relationship with the excess fuel discharge port of the pressure regulator.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

The First Embodiment

Figure 1:
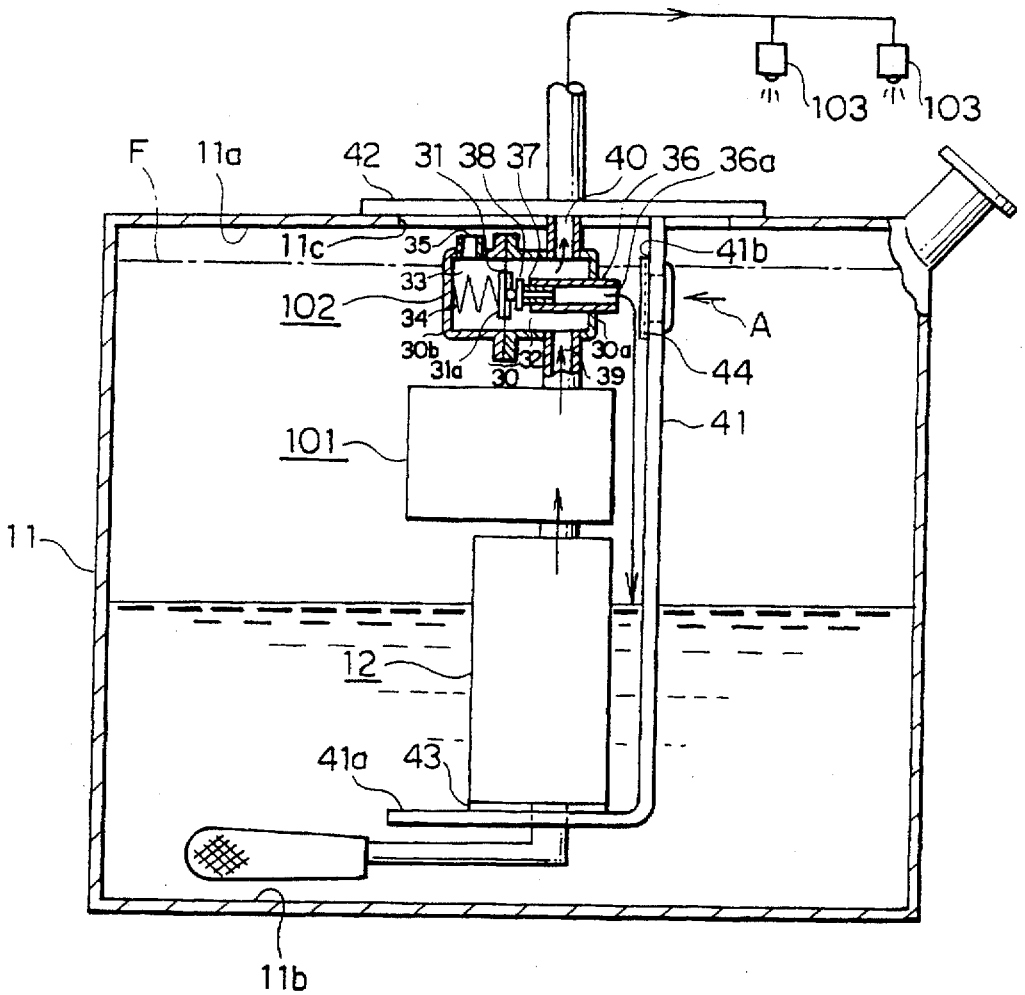
FIG. 1 is a partially sectional schematic view showing a fuel supplying apparatus of the first embodiment of the present invention.

FIG. 1 is a diagrammatic view of the fuel supplying apparatus of the first embodiment of the present invention. In the figure, the reference numeral 11 is a fuel tank, 12 is a fuel pump disposed inside of the fuel tank 11, 101 is a fuel filter for filtering the fuel discharged from the fuel pump 12, the fuel filter 101 being disposed in the flow path between the fuel pump 12 and a pressure regulator 102 at the upstream side of the pressure regulator 102. The pressure regulator 102 regulates the pressure of the fuel (hereinafter referred to as the fuel pressure) supplied to an injector 103 injecting the fuel into the internal combustion engine, by returning one portion of the supplied fuel as an excess amount of fuel (hereinafter referred to as the return fuel) to the fuel tank 11 through a return pipe 36 which will be described later, at a pressure higher by a predetermined value relative to the pressure within the fuel tank 11 (hereinafter referred to as the tank internal pressure).

The structure of the pressure regulator 102 will now be described in more detail. The reference numeral 30 is a housing, which is composed of a first housing member 30*a* and a second housing member 30*b* connected together in abutting relationship. The reference numeral 31 is a diaphragm portion held between the abutting surfaces of the first housing member 30*a* and the second housing member 30*b* in a gas and liquid tight-manner. The diaphragm portion 31 partitions the interior space of the housing 30 into a fuel chamber 32 and the diaphragm chamber 33 and is arranged so that it can be displaced in a reciprocating manner. The reference numeral 34 is a spring urging the diaphragm portion 31 toward the fuel chamber 32. 35 is a tank internal pressure introducing port secured to the second housing member 30*b* for introducing the tank internal pressure and the tank internal pressure introducing port 35 has its opening positioned in the vicinity of the top wall 11*a* of the fuel tank 11 and above the fuel surface F when the tank is full (shown in dot-and-dash line in FIG. 1). The reference numeral 36 is a return pipe secured to the first housing member 30*a*, and 37 is a valve seat inserted into one end of the return pipe 36. The reference numeral 38 is a valve body in which a ball is secured to a plate-like valve and the ball is rotatably supported by the diaphragm base 31*a* of the diaphragm portion 31, the valve body 38 being in separable facing relationship with the valve seat 37. The reference numeral 39 is a fuel inlet port and 40 is a fuel outlet port. The reference numeral 41 is a mounting bracket for mounting the fuel pump 12 within the fuel tank 11 and the mounting bracket 41 is made of a steel plate bent into substantially an L-shape, one end of the L being secured to the lid 42 for covering the mounting port 11*c* in the top wall 11*a* of the fuel tank 11 and the other end of the L supporting the fuel pump 12 at a receiving surface 41*a* through a rubber mount 43. It is to be noted that a wall surface 41*b* vertically downwardly extending relative to the lid 42 is formed in a planar configuration (not shown) as seen in the direction of an arrow A. The discharge port 36*a* at the tip of the return pipe 36 of the pressure regulator 102 opens in the vicinity of the planar wall surface 41*b* of the bracket 41 and the discharge port 36*a* faces against the wall surface 41*b*.

In the fuel supplying apparatus having the above-described structure, the fuel stored within the fuel tank 11 is sucked and pressurized by the fuel pump 12 to be flowed as shown in the arrows into the fuel filter 101 and it is filtered by the fuel filter 101 to be supplied to the pressure regulator 102. (The arrows indicate the flows of the fuel. The same is true hereinafter) The pressure regulator 102 returns one portion of the fuel through the return pipe 36 to the fuel tank 11, whereby the pressure of the fuel (referred to as fuel pressure) supplied to the injector 103 is adjusted at a value higher than the pressure within the tank introduced through the tank internal pressure introducing pipe 35 by a constant value (for example, 3.0 kgf/cm$^2$).

That is, when the fuel which is supplied from the fuel pump 12 to the pressure regulator 102 through the fuel filter 101 and which fills the fuel chamber 32 has a fuel pressure relatively higher than the set pressure set at a pressure higher by a constant value than the tank internal pressure introduced into the diaphragm chamber 33 through the tank internal pressure introducing pipe 35, the fuel pressure causes the diaphragm portion 31 to displace against the biasing force of the spring 34. This causes the diaphragm portion 31 and the valve body 38 to separate from the valve seat 37 disposed at the inlet port of the return pipe 36 to allow one portion of the fuel within the fuel chamber 32 to be charged as the return fuel into the fuel tank 11 through the return pipe 36, whereby the pressure of the fuel supplied from the fuel pump 12 to the injector 103 can be decreased.

On the other hand, when the fuel pressure within the fuel chamber 32 is lower than the pressure set at a pressure higher by a constant value than the tank internal pressure introduced into the diaphragm chamber 32 through the tank internal pressure introducing pipe 35, the diaphragm portion 31 is pushed by the spring 34 to displace the diaphragm portion 31 and the valve body 38 toward the valve seat 37 disposed at the inlet port of the return pipe 36. When the valve body 38 moves close to the valve seat 37, the open area of the inlet port of the return pipe 36 is limited to decrease the return amount of the fuel discharged from the fuel chamber 32 to the fuel tank 11 through the return pipe 36. Therefore, the pressure of the fuel supplied from the fuel pump 12 to the injector 103 can be increased.

In this manner, the pressure of the fuel supplied to the fuel chamber 32 in the pressure regulator 102 can be regulated at a constant value relative to the pressure within the fuel tank 11, whereby the pressure of the fuel supplied to the injector 103 can be maintained at a constant value.

Then, the fuel of which pressure is regulated at a value higher than the pressure within the fuel tank 11 by a predetermined value (3.0 kgf.cm$^2$, for example) by the pressure regulator 102 is supplied to the injector 103, from which it is injected into each cylinder of the engine (not shown) from the injector 103.

According to this embodiment, the fuel filter 101 is disposed on the upstream side of the pressure regulator 102. Therefore, since the pressure of the fuel is regulated by the pressure regulator 102 after the fuel flows through the fuel filter 101, the pressure of the fuel supplied to the injector 103 can be maintained at a constant value irrespective of the pressure loss at the fuel filter even when the pressure loss at the fuel filter 101 is changed due to the change in the state of the foreign matters trapped in the fuel filter 101.

Also, the tank internal pressure introducing port 35 of the pressure regulator 102 is disposed in the vicinity of the ceiling or the upper surface 11*a* of the fuel tank 11 so as to open at the position above the fuel level at the time of fully filled state, so that the tank internal pressure introducing port 35 does not submerge under the fuel surface and the pressure regulated by the pressure regulator 102 does not vary under the influence of the fuel head within the fuel tank 11.

Even if the fuel inadvertently enters into the diaphragm chamber 33, the fuel may be discharged through the use of the check valve when the fuel level is lowered.

Further, the discharge port 36*a* of the return pipe 36 of the pressure regulator 102 is opened at a position in the vicinity of the planar wall surface 41*b* of the mounting bracket 41 for mounting the fuel pump 12. Therefore, the fuel discharged from the discharge port 36*a* of the pressure regulator 102 impinges upon the wall surface 41*b* and flows downward therealong, so that the fuel does not generate noise by directly falling onto the fuel surface within the fuel tank 11 and that the need for the return pipe 36 to be extended up to the vicinity of the bottom wall 11*b* of the fuel tank 11 is eliminated.

It is to be noted that a shock absorbing member 44 made of a foam rubber or the like may be mounted to the position on the planar wall surface 41*b* of the mounting bracket 41 where the fuel discharged from the discharge port 36*a* of the return pipe 36 impinges, thereby to further moderate the noise.

The Second Embodiment

Figure 2:
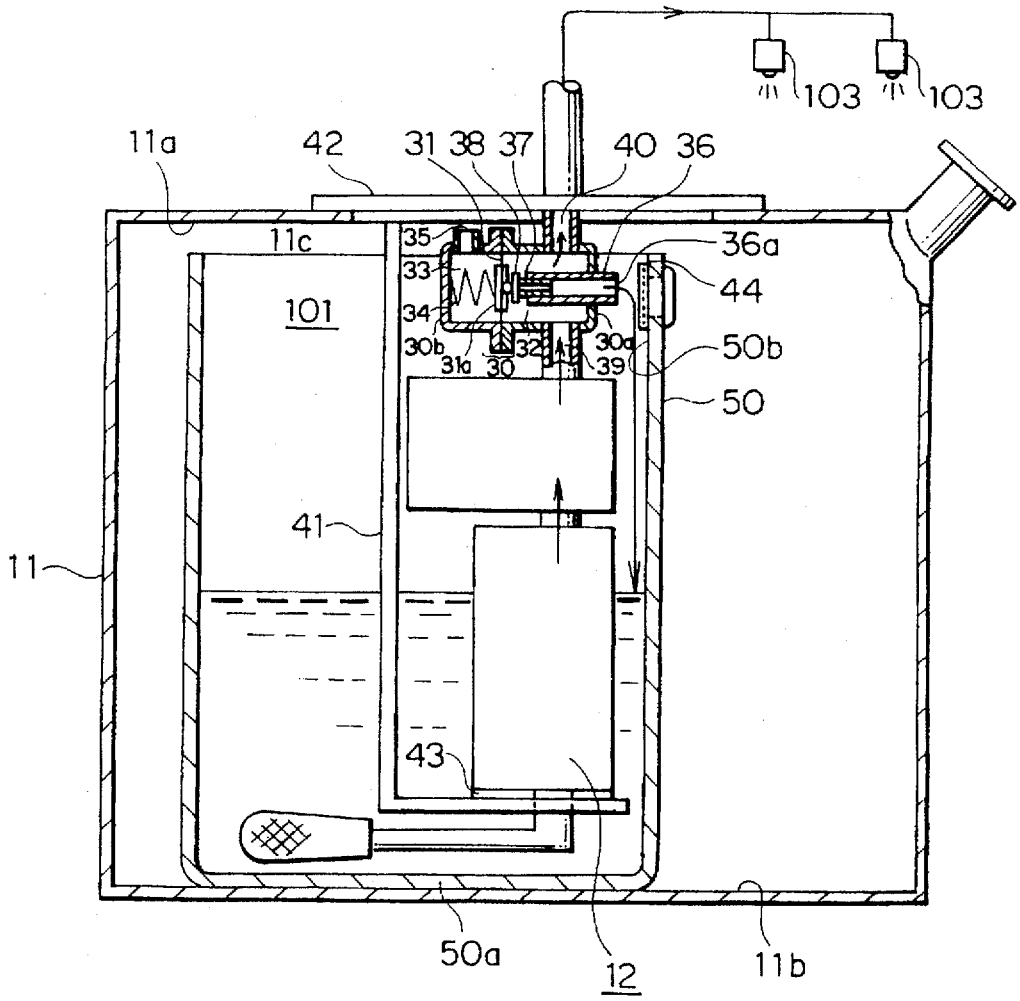
FIG. 2 is a partially sectional schematic view showing a fuel supplying apparatus of the second embodiment of the present invention.

While the discharge port 36*a* of the return pipe 36 of the pressure regulator 102 is disposed in opposition to the wall surface 41*b* of the fuel pump mounting bracket 41 in the first embodiment, the discharge port 36*a* may also be disposed as shown in FIG. 2 in opposition to the wall inner surface 50*b* of a sub-tank 50 which is provided within the fuel tank 11 and obtain similar advantageous results. It is to be noted that the sub-tank 50 is provided for the purpose of maintaining fuel available for the fuel pump 12 even when the fuel tank 11 is tilted. The sub-tank 50 is a substantially cup-shaped vessel having an open top end with its bottom wall 50*a* attached to the bottom wall 11*b* of the fuel tank 11 to define a partitioned space within the fuel tank 11. Although not illustrated, the sub-tank 50 may be held by the fuel pump mounting bracket 41 instead of being secured to the bottom wall 11*b* of the fuel tank 11 shown in FIG. 2.

It is to be noted that the portion of the wall surface 50*b* of the sub-tank 50 to which the fuel discharged from the discharge port 36*a* of the return pipe 36 impinges is provided with a shock absorber member 44 made of a foam rubber or the like to further decrease the noise.

The Third Embodiment

Figure 3:
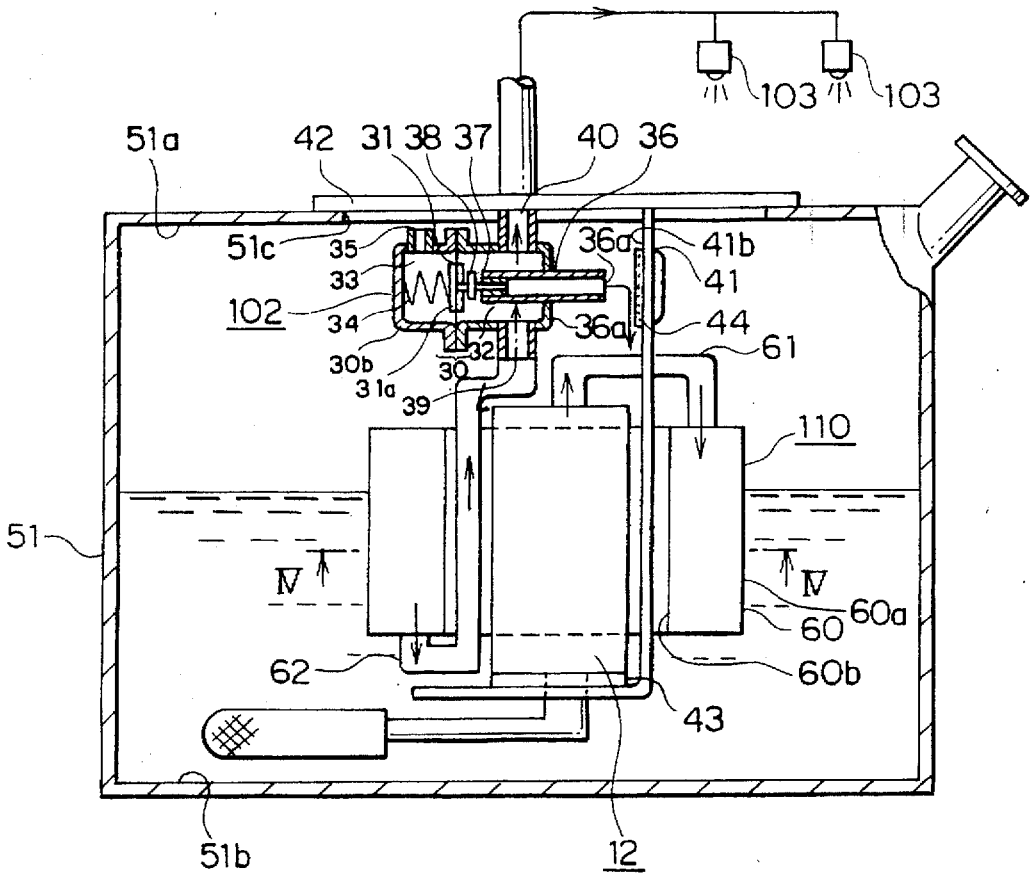
FIG. 3 is a partially sectional schematic view showing a fuel supplying apparatus of the third embodiment of the present invention.
Figure 4:
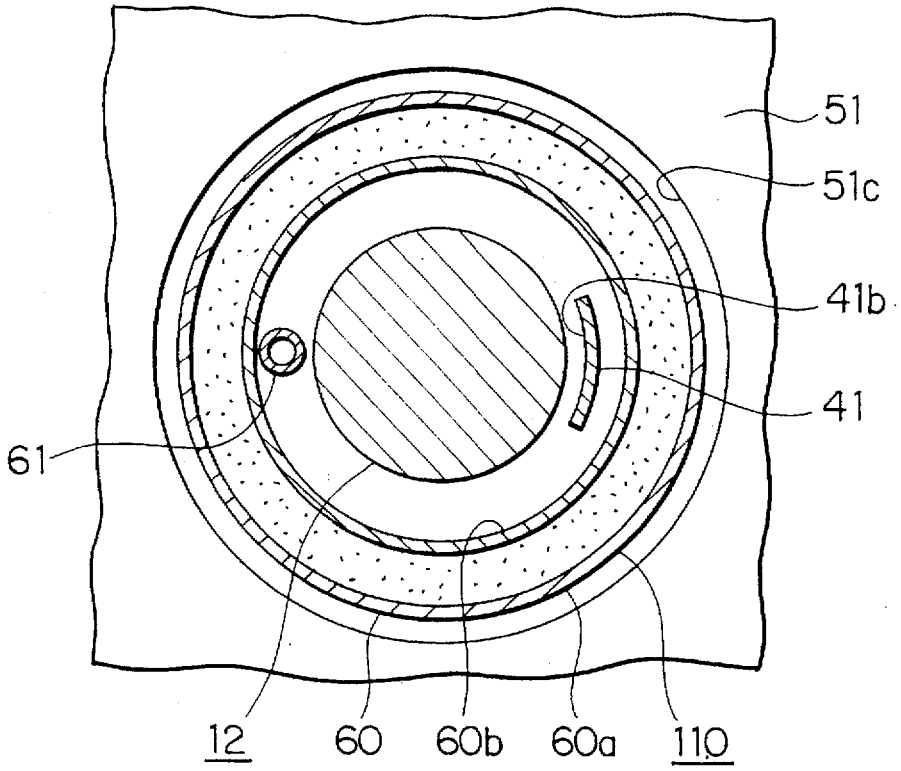
FIG. 4 is a sectional view of the main portion taken along line IV—IV of FIG. 3.

FIG. 3 is a partially sectional schematic view showing a fuel supplying apparatus of the third embodiment of the present invention, and FIG. 4 is a sectional view of the main portion taken along line IV—IV of FIG. 3. In the figures, the reference numeral 51 is a thin fuel tank having a small depth, and 51*a* is its top wall, 51*b* is its bottom wall and 51*c* is a mounting hole. The reference numeral 110 is a fuel filter for filtering any foreign matters entrained in the fuel discharged from the fuel pump 12. The fuel filter 110 comprises a filter element (not shown) contained within a hollow cylindrical case 60 having a cylindrical outer circumference portion 60*a* and an inner circumference hollow portion 60*b*. The hollow portion 60*b* may not be cylindrical. The reference numeral 61 is a pump discharge pipe for supplying the fuel from the fuel pump 12 to the fuel filter 110, 62 is a filter discharge pipe for supplying the fuel from the fuel filter 110 to the pressure regulator 102. It is to be noted that the fuel pump 12, the fuel pump mounting bracket 41 and the filter discharge pipe 62 are disposed inside of the hollow portion 60*b* of the fuel filter 110.

According to the third embodiment, the overall height dimension with the fuel pump 12 and the fuel filter 110 combined can be made small, making it easy to install in the thin-type fuel tank 51. Also, since the outer circumference portion 60*a* of the fuel filter 110 is cylindrical in shape without any undesirable projection, the diameter of the mounting hole 51*c* of the fuel tank 51 for mounting the fuel supplying apparatus can be made small.

The Fourth Embodiment

Figure 5:
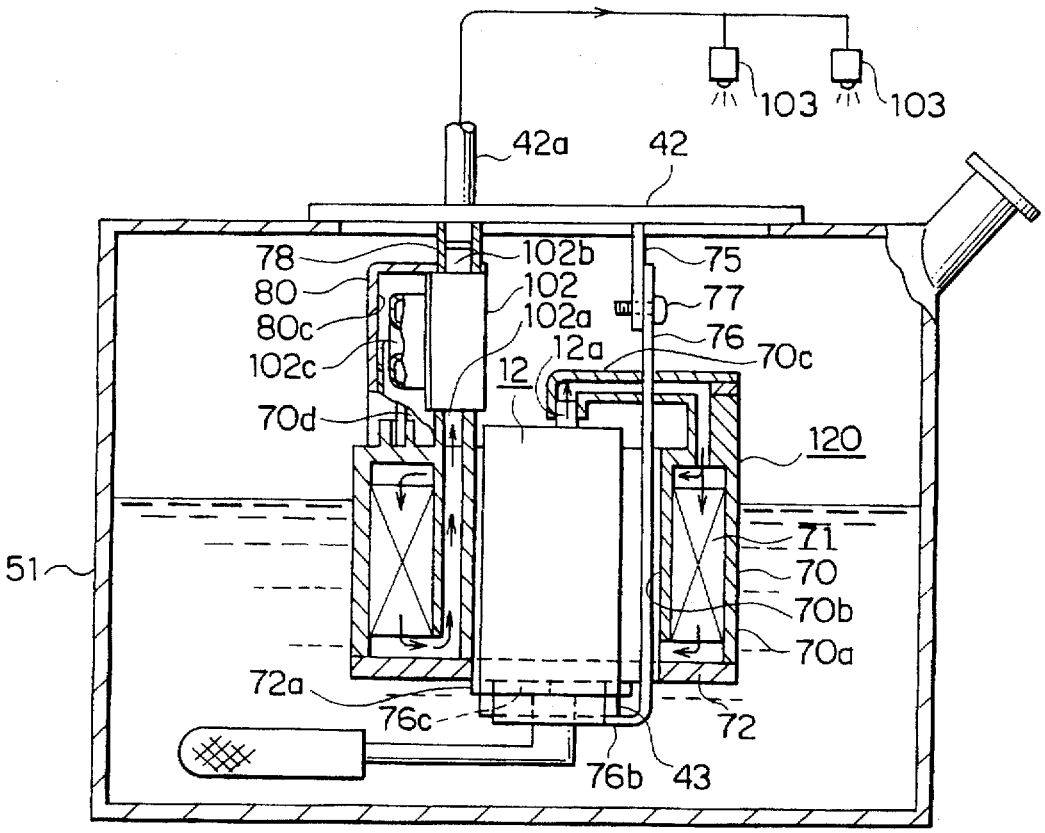
FIG. 5 is a partially sectional schematic view showing a fuel supplying apparatus of the fourth embodiment of the present invention.
Figure 6:
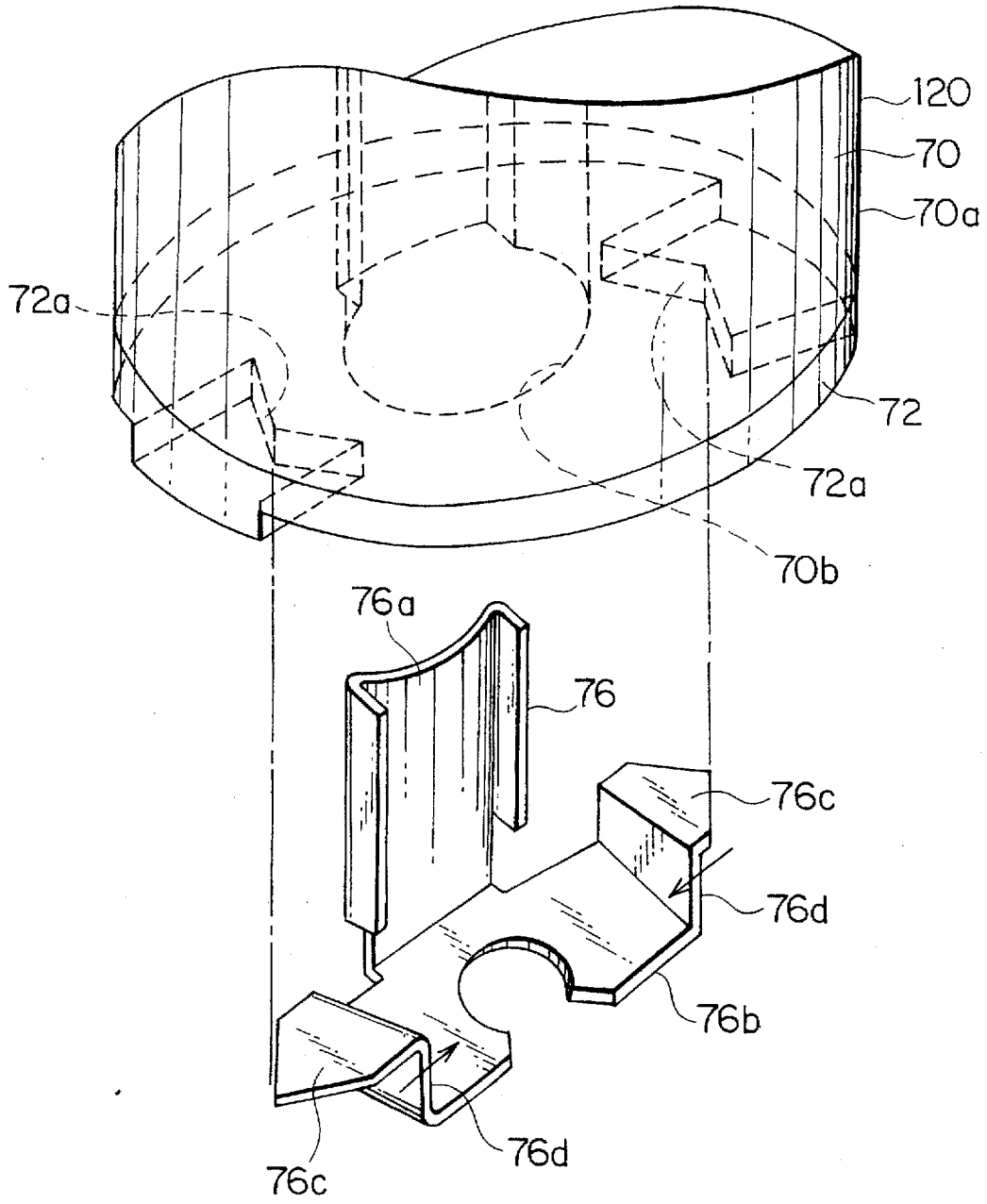
FIG. 6 is an exploded perspective view showing the main portion of the fuel filter mounting portion of the present invention.
Figure 7:
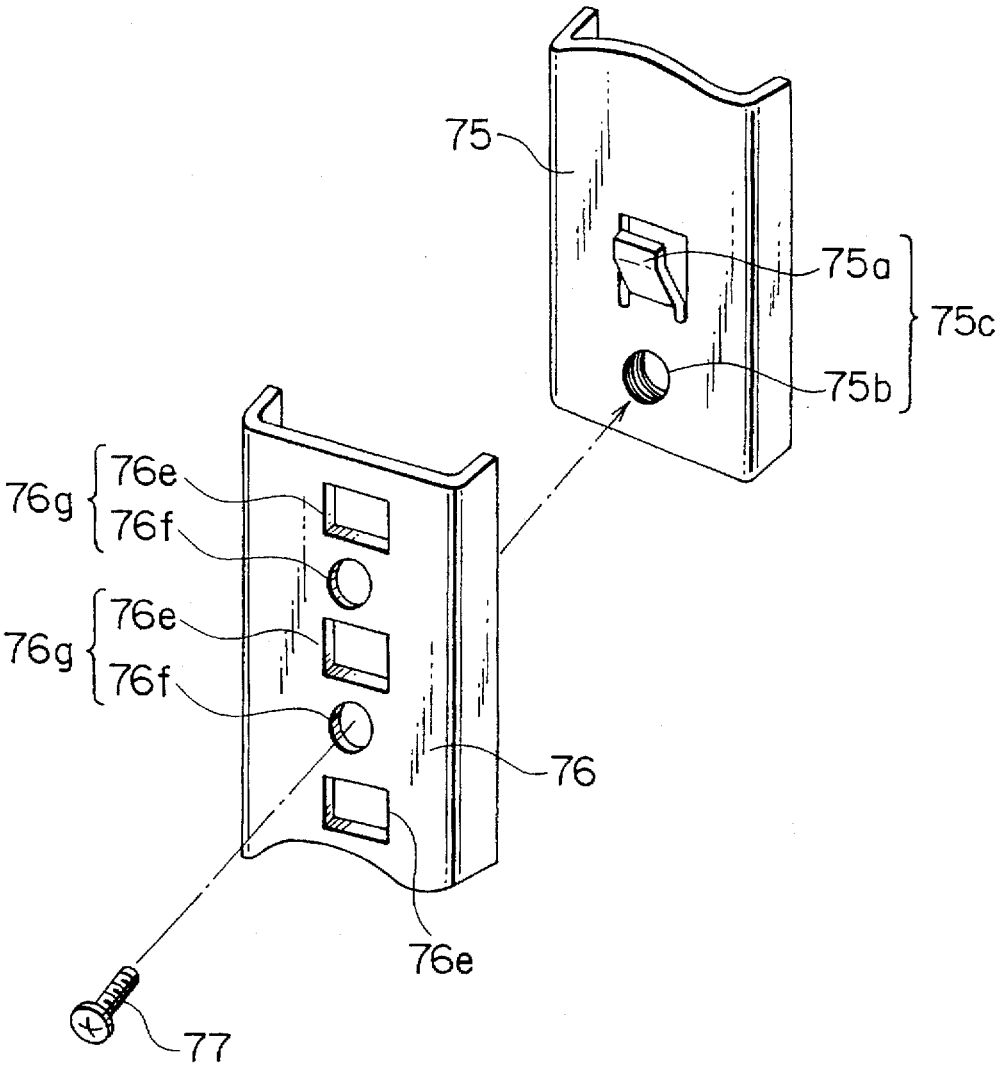
FIG. 7 is an exploded perspective view showing the main portion of the bracket for supporting the fuel filter of the present invention.

FIGS. 5 to 7 are views illustrating the fourth embodiment of the present invention, in which FIG. 5 is a partially sectional schematic view showing a fuel supplying apparatus of the fourth embodiment of the present invention, FIG. 6 is an exploded perspective view showing the main portion of the fuel filter mounting portion of the present invention and FIG. 7 is an exploded perspective view showing the main portion of the bracket for supporting the fuel filter of the present invention. In the figures, the reference numeral 120 is a fuel filter comprising a filter element 71 contained within a hollow cylindrical case 70 having a cylindrical outer circumference portion 70*a* and an inner circumference hollow portion 70*b*. The reference numeral 70*c* is a filter inlet pipe for supplying the fuel from the fuel pump 12 to the fuel filter 120, 70*b* is a filter outlet pipe for supplying the fuel from the fuel filter 120 to the pressure regulator 102, both being integrally formed with the case 70 of the fuel filter 120. For example, the filter inlet pipe 70*c* and the filter outlet pipe 70*d* are integrally molded with the case 70 which is molded with a thermoplastic resin. However, the filter inlet pipe 70*c* and the filter outlet pipe 70*d* may be mold-formed with a thermoplastic resin as separate members and welded to the case 70 into a unitary structure by the heat welding, ultrasonic welding or the like. The filter inlet pipe 70*c* and the filter outlet pipe 70*d* are directly, without using a rubber hose or the like, connected to the discharge pipe 12*a* of the fuel pump 12 and the regulator inlet pipe 102*a* of the pressure regulator 102 which will be described later, respectively.

The reference numeral 72 is a filter cover constituting one portion of the case 70 of the fuel filter 120, the filter cover 72 having formed therein a pair of a step portions 72*a* as shown in FIG. 6. The reference numeral 75 is a first bracket made of a steel plate secured to the lid 42 of the fuel tank 51 as shown in FIG. 5. The first bracket 75 may be attached to the lid 42 by bolts. The reference numeral 76 is a second bracket made of a steel plate. As shown in FIG. 6, the second bracket 76 comprises a vertical plate portion 76*a*, a pump support portion 76*b* for supporting the fuel pump 12 with a rubber mount 43 disposed at the bottom of the fuel pump 12 and a pair of filter engaging portions 76*c* for elastically engaging with the pair of the step portions 72*a* formed in the filter cover 72 of the fuel filter 120, with the engaging portions 76*c* elastically deformed in the direction shown by the arrows in the figure. Elastic deformation portions 76*d* and the filter engaging portion 76*c* together constitute a filter support portion.

As shown in FIG. 7, the first bracket 75 comprises a connection portion 75*c* composed of a claw portion 75*a* formed by cutting a portion of the steel plate and a female thread portion 75*b* for thread-inserting a mounting screw 77 for tightening the second bracket 76 to the first bracket 75, the claw portion 75*a* and the thread portion 75*b* constituting a connection portion 75*c*. The second bracket 76 has formed therein connection holes 76*g* including a plurality of square holes 76*e* for being engaged by the claw portion 75*a* of the first bracket 75 and a plurality of round holes 76*f* for allowing the mounting screw 77 to extend therethrough, whereby the connection position of the connection portion 75*c* of the first bracket 75 relative to the second bracket 76 can be selected to the most suitable position when the depth of the fuel tank 51 varies according to the type of the vehicle. The optimum connection position between the first and the second brackets 75 and 76 can also be selected by providing one connection hole 75*g* in the second bracket 76 and a plurality of connection portions 75*c* in the first bracket 75.

Figure 8:
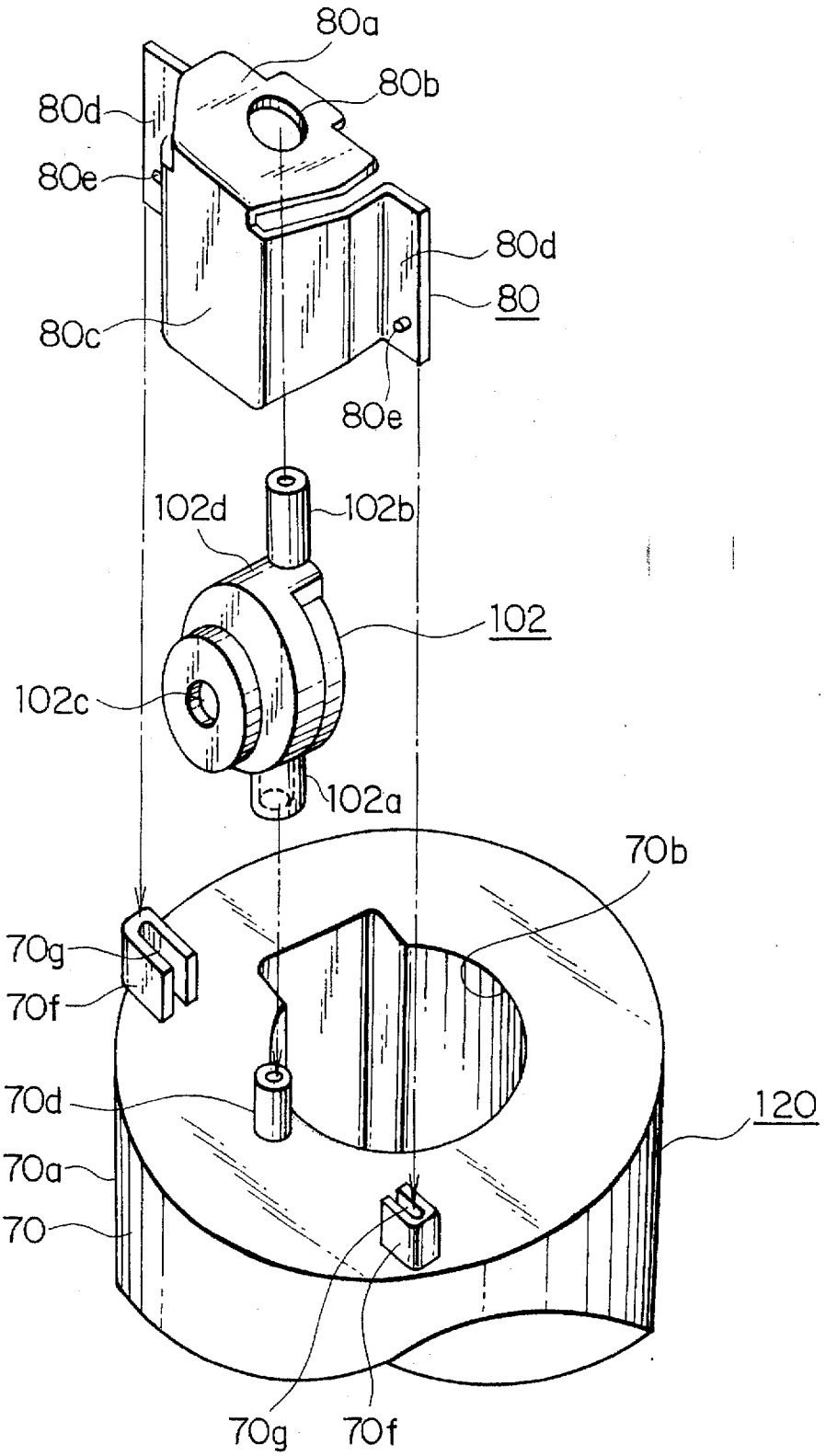
FIG. 8 is an exploded perspective view showing the main portion of the pressure regulator mounting portion of the present invention.

FIG. 8 is an exploded perspective view showing the main portion of the pressure regulator mounting portion of the present invention. It is seen that a pair of projections 70*f* having an engaging groove 70*g* are provided on the top surface of the fuel filter 120. The pressure regulator 102, which has a function similar to that of the first embodiment, has a fuel inlet port 102*a* for introducing the fuel filtered in the fuel filter 120, a fuel outlet port 102*b* (shown in FIG. 5) for supplying the fuel pressure regulated at a set value to the injector 103 through the fuel hose 78 and the fuel discharge pipe 42*a*, and a discharge port 102*c* for the return fuel. The reference numeral 80 is a holder for holding the pressure regulator 102. The holder 80 comprises a top wall surface 80*a* to which the upper end portion 102*d* of the pressure regulator 102 abuts and having therein a through hole 80*b* through which the fuel outlet portion 102*b* extends, a wall surface 80*c* bent at substantially right angles with respect to the top wall surface 80*a* and a pair of engaging portions 80*d* connected to the wall surface 80*c* for engaging the pair of engaging grooves 70*g* of the fuel filter 120. The reference numeral 80*e* are projections for preventing the engaging portions 80*d* from coming off from the projections 70*f*. To mount the pressure regulator 102 to the fuel filter 120, the fuel inlet port 102*a*, the fuel inlet port 102*a* is fitted over the filter outlet pipe 70*d* and the fuel outlet port 102*b* is inserted into the through hole 80*b* of the holder 80, with the pair of engaging portions 80*d* engaged into the pair of engaging grooves 70*g* of the fuel filter According to the fourth embodiment of the present invention, the filter inlet pipe 70*c* for introducing the fuel into the fuel filter 120 and the filter outlet pipe 70*d* for supplying the filtered fuel to the pressure regulator 102 are integrally formed into the case 70 of the fuel filter 120, and the filter inlet pipe 70*c* is directly connected to the discharge pipe 12*a* of the fuel pump 12 and the filter outlet pipe 70*d* is directly connected to the regulator inlet pipe 102*a* of the pressure regulator 102, so that the fuel hose or the like is not necessary and the assembly is easy.

Also, since the arrangement for mounting the fuel pump 12 and the fuel filter 120 to the fuel tank 51 is such that the first bracket 75 and the second bracket 76 are provided, the fuel pump 12 is held by the pump holder portion 76*b* of the second bracket 76, the pair of filter engaging portions 76*c* are elastically engaged with the pair of step portions 72*a* of the fuel filter 120 (the filter cover 72) to support the fuel filter 120, the second bracket 76 is provided with the plurality of connection holes 76*g* including the square holes 76*e* and the circular holes 76*f*, and that the connection portion 75*c* of the first bracket 75 is made selectively engaged with one of the plurality of connection holes 75*g*, the fuel pump 12 and the fuel filter 120 can be easily supported by a single bracket, the vibration resistivity can be improved and, even when the depth of the fuel tank 51 varies from tank to tank according to the type of the vehicle, the bracket can be used in common by simply changing the connection position without the need for replacing with a new bracket.

Further, the holder 80 for supporting the pressure regulator 102 is mounted to the fuel filter 120 and the wall surface 80*c* of the holder 80 is positioned to oppose to the return fuel discharge port 102*c* of the pressure regulator 102, so that the discharged return fuel impinges upon the wall surface 80*c* of the holder 80 and flows down along the wall surface 80*c* and the outer circumference 70*a* of the case 70, whereby the noise can be decreased and the mounting position of the pressure regulator 102 need not to be limited to the vicinity of the wall surface of the first bracket 75 or the second bracket 76.

The Fifth Embodiment

Figure 9:
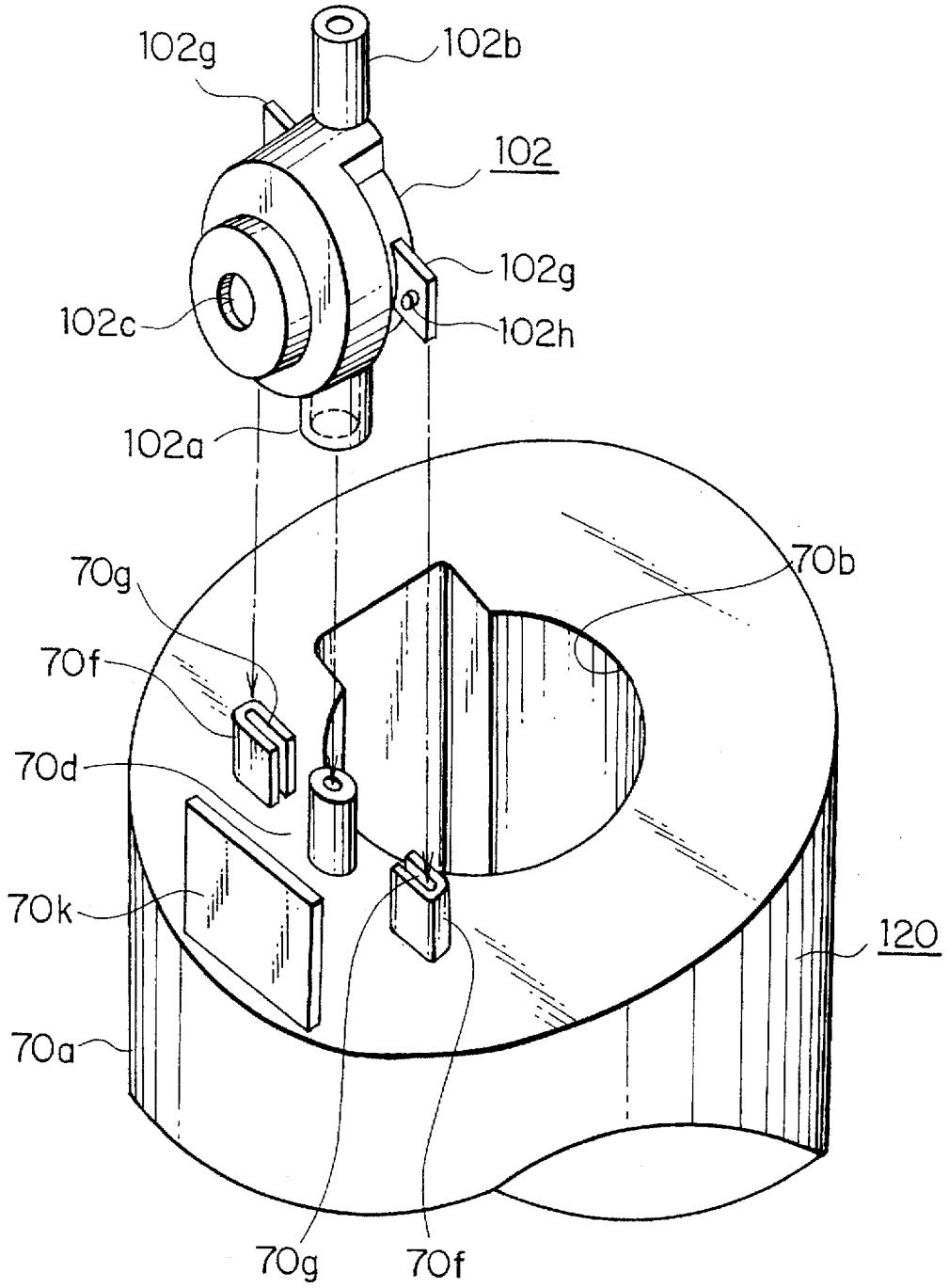
FIG. 9 is an exploded perspective view showing the main portion of the pressure regulator mounting portion of the fifth embodiment of the present invention.
Figure 10:
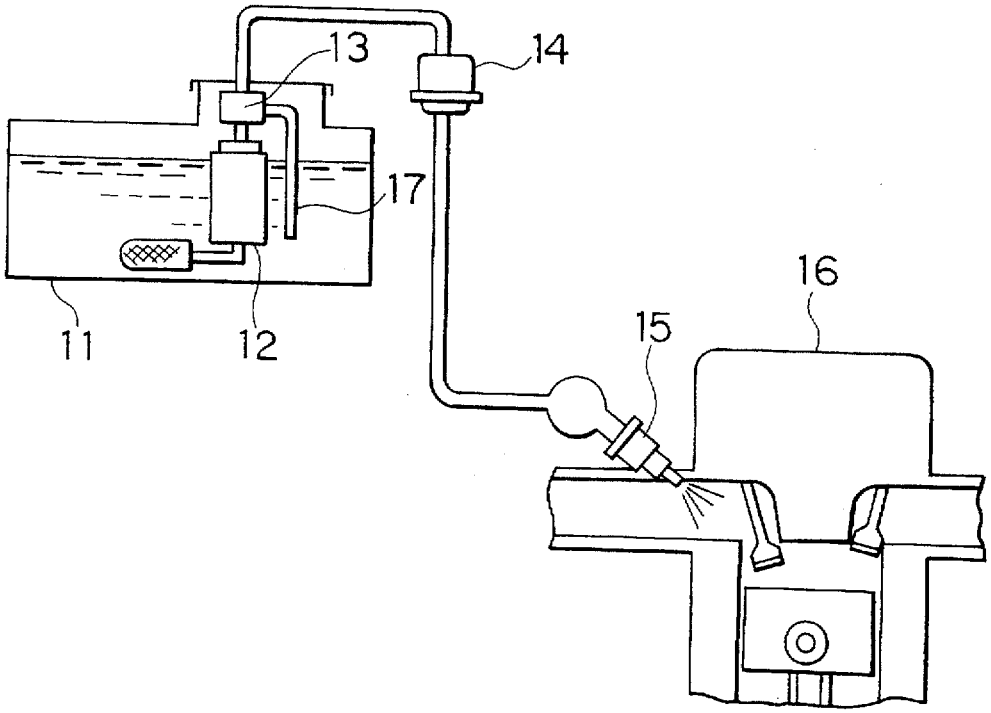
FIG. 10 PRIOR ART
FIG. 10 is a diagrammatic view of a conventional fuel supplying apparatus.
Figure 11:
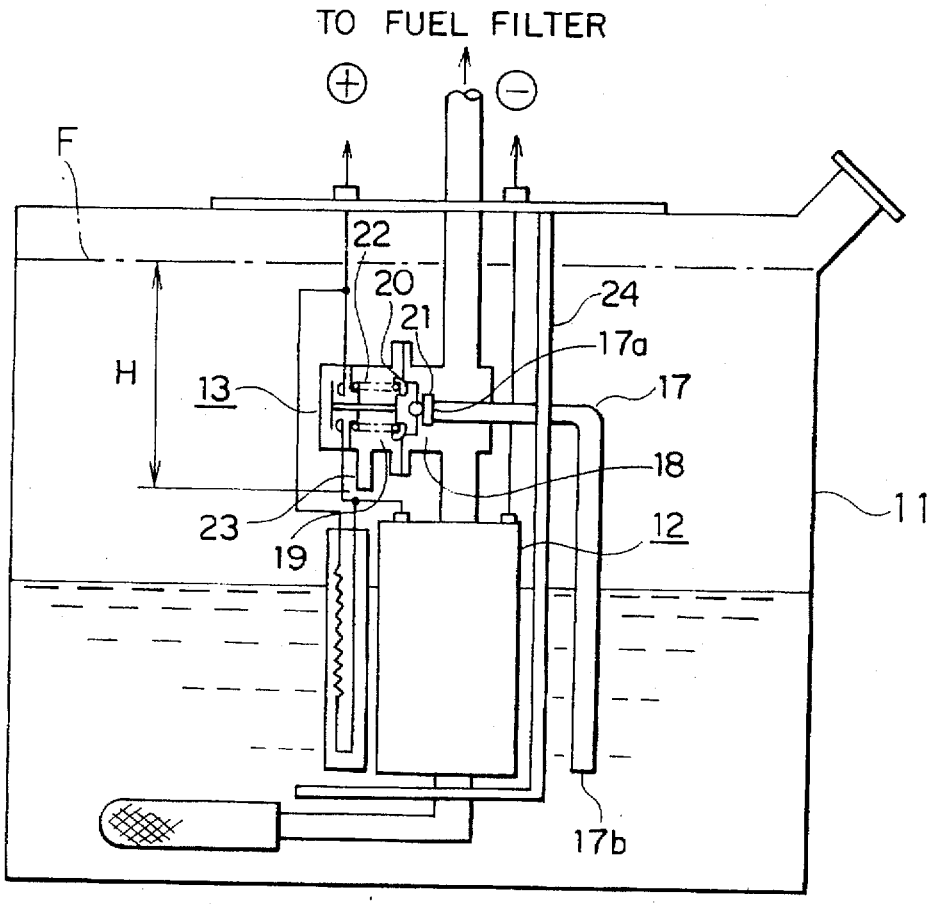
FIG. 11 PRIOR ART
FIG. 11 is a schematic view showing the main portion within the fuel tank of the conventional fuel supplying apparatus.

FIG. 9 is an exploded perspective view showing the main portion of the pressure regulator mounting portion of the fifth embodiment of the present invention. In the figure, the reference numeral 102*g* is a pair of legs disposed to the pressure regulator 102 and the legs 102*g* have disengagement prevention projections 102*h* and are engaged with the pair of engaging grooves 70*g* of the fuel filter 120. The reference numeral 70*k* is a barrier wall projecting from the top surface of the case 70 of the fuel filter 120, the barrier wall 70*k* being positioned in an opposing relationship relative to the return fuel discharge port 102*c* of the pressure regulator 102.

According to the fifth embodiment, the return fuel discharged from the discharge port 102*c* of the pressure regulator 102 impinges upon the barrier wall 70*k* and flows down along the barrier 70*k* and the outer circumference portion 70*a*, so that the noise can be decreased and the mounting position of the pressure regulator 102 need not to be limited to a position in the vicinity of the wall surface of the first bracket 75 or the second bracket 76.

The advantageous results which will be discussed below can be obtained according to the present invention having an arrangement as has been described.

Since the fuel filter disposed in a fuel tank for filtering the fuel discharged from the fuel pump is disposed upstream of the pressure regulator, the fuel pressure supplied to the injector can be regulated at a set value without being affected by the pressure loss at the fuel filter.

Also, since the pressure regulator has an inlet port through which the pressure within the fuel tank is introduced into the diaphragm chamber of the pressure regulator which inlet port is disposed between a fuel surface level and the ceiling of the fuel tank, no pressure change occurs in the fuel pressure regulated by the pressure regulator due to the fuel head within the fuel tank.

Also, the excess fuel discharge port of the pressure regulator is disposed in the vicinity of and in a facing relationship to a wall surface of a mounting bracket for supporting the fuel pump, so that the return fuel of the pressure regulator flows along the wall surface of the fuel pump mounting bracket, enabling the noise to be decreased and the return pipe to be shortened.

The excess fuel discharge port of the pressure regulator is disposed in the vicinity of and in a facing relationship to a wall surface of the sub-tank disposed within the fuel tank, so that the return fuel of the pressure regulator flows along the wall surface of the sub-tank, enabling the noise to be decreased and the return pipe to be shortened.

Also, a shock absorbing member is disposed on the wall surface to which the fuel discharged from the excess fuel discharge port impinges, so that the noise can be further decreased.

Also, the fuel filter may have a hollow cylindrical configuration and the fuel pump together with a mounting bracket for supporting the fuel pump is housed within the hollow cylindrical fuel filter, so that the overall height dimension of the assembly of the fuel pump and the fuel filter can be decreased, making the installation to the thin-type tank easier.

Also, the fuel filter may have a hollow cylindrical configuration, the fuel pump together with a mounting bracket for supporting the fuel pump is housed within the hollow cylindrical fuel filter, the fuel filter has integrally formed therein a filter input pipe through which the fuel flows into the fuel filter and a filter output pipe through which the filtered fuel flows out from the filter to the pressure regulator, and the filter inlet pipe is directly connected to a fuel outlet pipe of the fuel pump and the filter outlet pipe is directly connected to a regulator inlet pipe of the pressure regulator, so that the fuel hose is not needed and the assembly is easy.

Also, the provision is made of a first bracket secured to a cover of the fuel tank, a second bracket connected to the first bracket selectively at a connection portion of the first bracket, a pump holder portion disposed to the second bracket for holding the fuel pump and a filter holding portion disposed to the second bracket for elastically holding the fuel filter, so that the fuel pump and the fuel filter can be easily supported by the brackets, improving the vibration resistance and there is no need for the bracket to be replaced with a new bracket and the bracket can be used in common by simply changing the connection position even when the depth of the fuel tank 51 varies from tank to tank according to the type of the vehicle.

Also, the fuel filter has mounted thereon a holder for holding the pressure regulator, the holder having a wall surface disposed in a facing relationship with the excess fuel outlet port of the pressure regulator, so that the return fuel flows down along the wall surface of the holder, whereby the noise can be decreased and the mounting position of the pressure regulator is not needed to be limited to the vicinity of the wall surface of the first bracket or the second bracket.

Further, a barrier wall is mounted to a case of the fuel filter such that the barrier wall is in a facing relationship with the excess fuel discharge port of the pressure regulator, so that the return fuel discharged from the pressure regulator flows down along the barrier, whereby the noise can be decreased and the mounting position of the pressure regulator need not to be limited to a position in the vicinity of the wall surface of the first bracket or the second bracket.

What is claimed is:

1. A fuel supplying apparatus comprising:

a fuel tank;

a fuel pump disposed within said fuel tank for pumping fuel to a fuel injector of an internal combustion engine;

a pressure regulator disposed within said fuel tank for regulating the pressure of said fuel pumped from said fuel pump and for returning an excess amount of said fuel from a fuel supply path to said fuel injector to said fuel tank as an excess fuel; and a fuel filter disposed in a fuel line connected between said fuel pump and said pressure regulator, said fuel filter positioned upstream of said pressure regulator, for filtering said fuel supplied from said fuel pump; and wherein said pressure regulator comprises an excess fuel outlet port disposed in the vicinity of and in a facing relationship to a wall surface of a mounting bracket for supporting said fuel pump within said fuel tank.

2. A fuel supplying apparatus as claimed in claim 1, wherein said pressure regulator having defined therein a diaphragm chamber and a fuel chamber partitioned by a diaphragm portion, said fuel chamber receiving a supply of fuel pumped from said fuel pump and pumping the fuel to said fuel injector, said diaphragm chamber supplying the excess fuel to said fuel tank by the displacement of said diaphragm portion in response to the fuel pressure within said fuel chamber relative to the pressure within said diaphragm chamber for regulating the fuel pressure within said fuel chamber, and wherein said pressure regulator having an inlet port through which the pressure within said fuel tank is introduced into said diaphragm chamber of said pressure regulator is disposed between a fuel surface level and the ceiling of said fuel tank.

3. A fuel supplying apparatus as claimed in claim 1, wherein said fuel tank is provided therein with a sub-tank for maintaining therein a fuel for being suctioned by said fuel pump when the fuel tank is tilted, and wherein said pressure regulator comprises an excess fuel outlet port disposed in the vicinity of and in a facing relationship to a wall surface of said sub-tank.

4. A fuel supplying apparatus as claimed in claim 1, wherein said wall surface to which fuel discharged from said excess fuel outlet port impinges comprises a shock absorbing member.

5. A fuel supplying apparatus as claimed in claim 1, wherein said fuel filter has a hollow cylindrical configuration and said fuel pump together with a mounting bracket for supporting said fuel pump is housed within said hollow cylindrical fuel filter.

6. A fuel supplying apparatus comprising:

a fuel tank;

a fuel pump disposed within said fuel tank for pumping fuel to a fuel injector of an internal combustion engine;

a pressure regulator disposed within said fuel tank for regulating the pressure of said fuel pumped from said fuel pump and for returning an excess amount of said fuel from a fuel supply path to said fuel injector to said fuel tank as an excess fuel; and a fuel filter disposed in a fuel line connected between said fuel pump and said pressure regulator, said fuel filter positioned upstream of said pressure regulator, for filtering said fuel supplied from said fuel pump; and wherein said fuel filter has a hollow cylindrical configuration, said fuel pump together with a mounting bracket for supporting said fuel pump is housed within said hollow cylindrical fuel filter, said fuel filter having integrally formed therein a filter in-flow pipe through which the fuel flows into said fuel filter and filter out-flow pipe through which the filtered fuel flows out from said filter to said pressure regulator, and wherein said filter in-flow pipe is directly connected to a fuel outlet pipe of said fuel pump and said filter out-flow pipe is directly connected to a regulator in-flow pipe of said pressure regulator.

7. A fuel supplying apparatus as claimed in claim 6, further comprising a first bracket secured to a cover of said fuel tank, a second bracket connected to said first bracket selectively at a connection portion of said first bracket, a pump holder portion disposed to said second bracket for holding said fuel pump and a filter holding portion disposed to said second bracket for elastically holding said fuel filter.

8. A fuel supplying apparatus as claimed in claim 6, wherein said fuel filter has mounted thereon a holder for holding said pressure regulator, said holder having a wall surface disposed in a facing relationship with said excess fuel outlet port of said pressure regulator.

9. A fuel supplying apparatus as claimed in claim 6, further comprising a barrier wall mounted to a case of said fuel filter such that said barrier wall is in a facing relationship with said excess fuel discharge port of said pressure regulator.

10. A fuel supplying apparatus as claimed in claim 2, wherein said fuel tank is provided therein with a sub-tank for maintaining therein a fuel for being suctioned by said fuel pump when the fuel tank is tilted, and wherein said pressure regulator comprises an excess fuel outlet port disposed in the vicinity of and in a facing relationship to a wall surface of said sub-tank.

11. A fuel supplying apparatus as claimed in claim 3, wherein said wall surface to which fuel discharged from said excess fuel outlet port impinges comprises a shock absorbing member.

12. A fuel supplying apparatus as claimed in claim 2, wherein said fuel filter has a hollow cylindrical configuration and said fuel pump together with a mounting bracket for supporting said fuel pump is housed within said hollow cylindrical fuel filter.

13. A fuel supplying apparatus as claimed in claim 1, wherein said fuel filter has a hollow cylindrical configuration and said fuel pump together with a mounting bracket for supporting said fuel pump is housed within said hollow cylindrical fuel filter.

14. A fuel supplying apparatus as claimed in claim 3, wherein said fuel filter has a hollow cylindrical configuration and said fuel pump together with a mounting bracket for supporting said fuel pump is housed within said hollow cylindrical fuel filter.

15. A fuel supplying apparatus as claimed in claim 4, wherein said fuel filter has a hollow cylindrical configuration and said fuel pump together with a mounting bracket for supporting said fuel pump is housed within said hollow cylindrical fuel filter.

16. A fuel supplying apparatus as claimed in claim 7, wherein said fuel filter has mounted thereon a holder for holding said pressure regulator, said holder having a wall surface disposed in a facing relationship with said excess fuel outlet port of said pressure regulator.

17. A fuel supplying apparatus as claimed in claim 7, further comprising a barrier wall mounted to a case of said fuel filter such that said barrier wall is in a facing relationship with said excess fuel discharge port of said pressure regulator.

* * * * *

UNITED STATES PATENT AND TRADEMARK OFFICE

CERTIFICATE OF CORRECTION

PATENT NO. : 5,762,047

DATED : June 9, 1998

INVENTOR(S) : Hiroshi YOSHIOKA et al

It is certified that error appears in the above-indentified patent and that said Letters Patent is hereby corrected as shown below:

In Column 8, line 54, delete "75g " and insert -- 76g --.

In Column 9, line 37, delete "75g" and insert -- 76g --.

Signed and Sealed this

Fourth Day of May, 1999

*Attest:*

Q. TODD DICKINSON

*Attesting Officer*

*Acting Commissioner of Patents and Trademarks*